US008575530B2

(12) United States Patent
Chan et al.

(10) Patent No.: US 8,575,530 B2
(45) Date of Patent: Nov. 5, 2013

(54) PHOTOSENSITIVE CIRCUIT AND SYSTEM FOR PHOTOSENSITIVE DISPLAY

(75) Inventors: Issac Wing-Tak Chan, Hsinchu (TW); Chen-Pang Kung, Taoyuan County (TW)

(73) Assignee: Industrial Technology Research Institute, Hsinchu (TW)

( * ) Notice: Subject to any disclaimer, the term of this patent is extended or adjusted under 35 U.S.C. 154(b) by 248 days.

(21) Appl. No.: 12/979,920

(22) Filed: Dec. 28, 2010

(65) Prior Publication Data

US 2012/0061556 A1 Mar. 15, 2012

(30) Foreign Application Priority Data

Sep. 14, 2010 (TW) ..... 99130988 A
Dec. 7, 2010 (TW) ..... 99142543 A

(51) Int. Cl.
*G09G 3/34* (2006.01)

(52) U.S. Cl.
USPC ..... 250/208.1; 250/214 R; 345/84

(58) Field of Classification Search
USPC ..... 250/208.1, 214 R, 214 LS, 214 SW; 345/84, 87, 100, 173, 175
See application file for complete search history.

(56) References Cited

U.S. PATENT DOCUMENTS 4,345,248 A 8/1982 Togashi et al.
4,931,661 A 6/1990 Fukaya et al.
5,075,237 A 12/1991 Wu
5,306,648 A 4/1994 Fukaya et al.
5,338,690 A 8/1994 Fukaya et al.
5,627,088 A 5/1997 Fukaya et al.
5,864,146 A 1/1999 Karellas
6,888,571 B1 5/2005 Koshizuka et al.
6,992,322 B2 1/2006 Narayan
7,009,663 B2 3/2006 Abileah et al.
7,053,967 B2 5/2006 Abileah et al.
7,280,102 B2 10/2007 Abileah et al.
7,408,598 B2 8/2008 Den Boer et al.
7,569,832 B2 8/2009 Tredwell et al.
2006/0187367 A1 8/2006 Abileah et al.
2006/0214893 A1 9/2006 Tseng et al.

(Continued)

FOREIGN PATENT DOCUMENTS

CN 1751330 A 3/2006
CN 101471034 A 7/2009

(Continued)

OTHER PUBLICATIONS

CN Office Action dated May 6, 2013.

*Primary Examiner* — Kevin Pyo
(74) *Attorney, Agent, or Firm* — Muncy, Geissler, Olds & Lower, PLLC

(57) ABSTRACT

A photosensitive circuit is provided. The photosensitive circuit is adapted to a pixel in a pixel array. The photosensitive circuit includes a display element for generating light, transmitting light, or reflecting light, a control circuit coupled to the display element for controlling light intensity of the display element according to a data line and a gate line, and a photosensitive element coupled between the gate line and a read line for generating current at the read line to sense the position of an object according to a reflected light or a shadow from ambient light when light from the display element is reflected by an object or ambient light is shadowed by the object. The control terminal of the photosensitive element is connected to another gate line.

18 Claims, 6 Drawing Sheets

(56) References Cited

U.S. PATENT DOCUMENTS

| | | | | |
|---|---|---|---|---|
| 2007/0184576 | A1 | 8/2007 | Chang et al. | |
| 2007/0279346 | A1 | 12/2007 | Den Boer et al. | |
| 2007/0291325 | A1 | 12/2007 | Toyota et al. | |
| 2008/0087803 | A1 | 4/2008 | Yamamoto | |
| 2008/0129914 | A1 | 6/2008 | De Boer et al. | |
| 2008/0170982 | A1 | 7/2008 | Zhang et al. | |
| 2008/0186289 | A1 | 8/2008 | Ijima et al. | |
| 2008/0245968 | A1 | 10/2008 | Tredwell et al. | |
| 2009/0159786 | A1 | 6/2009 | Yang et al. | |
| 2009/0236504 | A1 | 9/2009 | Yamaguchi | |
| 2010/0039408 | A1 | 2/2010 | Cho et al. | |
| 2010/0103130 | A1 | 4/2010 | Kang et al. | |
| 2011/0169772 | A1* | 7/2011 | Liu et al. | 345/175 |

FOREIGN PATENT DOCUMENTS

| | | | |
|---|---|---|---|
| EP | 0 178 148 | A2 | 4/1986 |
| EP | 0 232 083 | B1 | 4/1995 |
| EP | 0 804 807 | B1 | 7/1999 |
| JP | 2009157148 | A | 7/2009 |
| JP | 2010195600 | A | 9/2010 |
| TW | M345293 | | 11/2008 |
| TW | 200846996 | | 12/2008 |
| TW | M368266 | U1 | 11/2009 |
| WO | WO 2005/104234 | A1 | 11/2005 |
| WO | WO 2007/015710 | A2 | 2/2007 |
| WO | WO 2007/058924 | A2 | 5/2007 |

* cited by examiner

PHOTOSENSITIVE CIRCUIT AND SYSTEM FOR PHOTOSENSITIVE DISPLAY

CROSS REFERENCE TO RELATED APPLICATION

This application claims priority of Taiwan Patent Application No. 99142543, filed on Dec. 7, 2010, which claims the benefit of Taiwan Patent Application No. 99130988, filed on Sep. 14, 2010, the entirety of which is incorporated by reference herein.

BACKGROUND

1. Field of the Disclosure

The present disclosure relates to a circuit and a display system, and in particular relates to a photosensitive circuit and a photosensitive display system.

2. Description of the Related Art

Touch panel technology has been widely used in commercial electronic devices such as PDAs, mobile phones and laptop computers etc. Touch panels provide an intuitive user interface and have the multi-touch ability that is not achievable by using conventional mouse input interface. Touch panel technology uses various materials and has various structures and designs. For example, add-on type touch panels with resistive type, capacitive type and other type designs have been developed for many years and are used in commercial applications. Recently, in-cell integrated touch panels have gained much attention due to their simpler structures, and low-cost manufacturing. Of all the in-cell-type touch panels, photo-sensing is an attractive scheme because photosensor arrays can be integrated into display panels by leveraging the mature TFT-LCD industrial technology without additional large capital investments. Also, the photosensitive display may be used to sense the photo images of the objects that come into contact with the display and may operate as a scanner with real-time display.

U.S. Pat. No. 4,345,248 discloses a liquid crystal display device with write-in capability, wherein display data lines and readout lines of the photosensitive elements share the column lines, and the photosensitive element is a two-terminal rectifier. The display signal and the photosensitive signal are transmitted with a time sharing manner. However, a photocurrent may be leaked into a display data input due to shared column lines.

U.S. Pat. No. 7,053,967 discloses a light sensitive display, wherein photosensitive elements and a readout circuit are disposed between LCD pixels. That is, photo-sensors are disposed between column lines and row lines. For example, there may be 30 lines sharing a sensor. The current is generated by the sensor according to ambient light charges or discharges the capacitor Cst. However, the column lines connected with the sensors may appear as dim lines, causing a non-uniform display of the image.

Thus, a display circuit and a display device for low signal leakage and high display uniformity is provided.

BRIEF SUMMARY

A detailed description is given in the following embodiments with reference to the accompanying drawings.

In one embodiment, the disclosure provides a photosensitive circuit which is adapted to a pixel in a pixel array. The photosensitive circuit comprises: a display element for generating light, transmitting light or reflecting light; a control circuit, coupled to the display element, for controlling light intensity of the display element according to a data line and a gate line; and a photosensitive element, coupled between the gate line and a readout line, for generating a current to sense a position of an object according to a light signal from the display element reflected by the object or a shadow on the photosensitive element casted by the object blocking the ambient light, wherein a control terminal of the photosensitive element is coupled to a gate line of another pixel.

In another embodiment, the disclosure provides a photosensitive circuit. The photosensitive circuit comprises a pixel unit and a photosensitive unit. The pixel unit comprises four pixels, wherein each pixel comprises a display element and a control circuit. The photosensitive unit is coupled between the four pixels and is used for generating a current to sense a position of an object according to a light signal from the display element reflected by the object or a shadow on the photosensitive element casted by the object blocking the ambient light. The photosensitive unit comprises at least one photosensitive element, coupled between a first gate line and the readout line. Wherein a control terminal of the photosensitive element is coupled to a second gate line.

BRIEF DESCRIPTION OF DRAWINGS

The present disclosure can be more fully understood by reading the subsequent detailed description and examples with references made to the accompanying drawings, wherein.

DETAILED DESCRIPTION

The following description is of the mode of carrying out the disclosure. This description is made for the purpose of illustrating the general principles of the disclosure and should not be taken in a limiting sense. The scope of the disclosure is best determined by reference to the appended claims.

Figure 1:
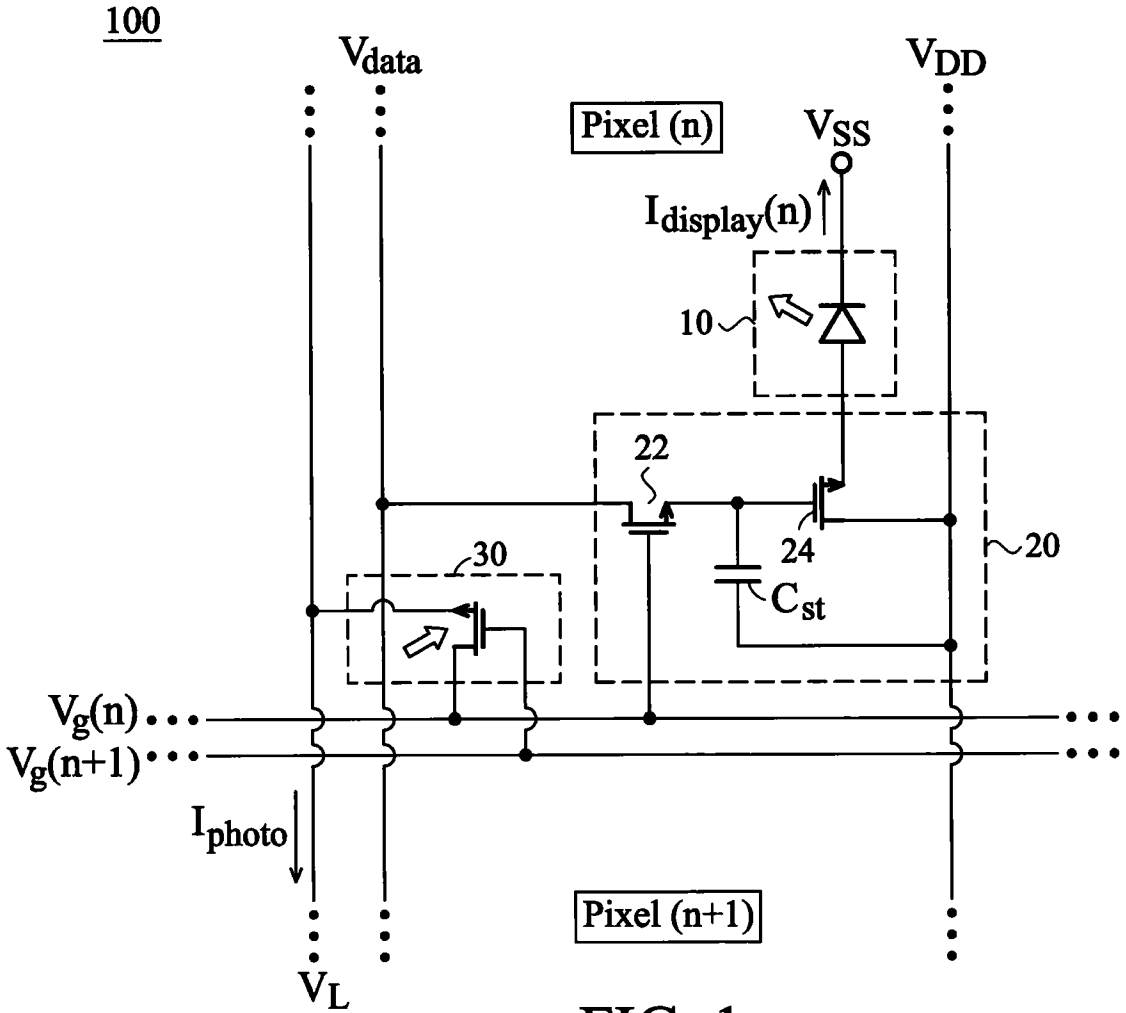
FIG. 1 is a photosensitive circuit of a pixel of an embodiment.

FIG. 1 is a photosensitive circuit of a pixel of an embodiment. Each pixel 100 includes a display element 10, a control circuit 20 and a photosensitive element 30.

The display element 10 is used to generate light, transmit light or reflect light. The display element 10 may be an organic light emitting diode (OLED), but is not limited thereto. The control circuit 20 is coupled to the display element 10. The control circuit 20 can control light intensity from the display element 10 according to logic levels from data lines and gate lines. In one embodiment, a switch element such as a transistor is able to control and drive the display element 10 if the photosensitive circuit is applied to the TFT LCD. In the embodiment of the disclosure, the photosensitive circuit is applied to an OLED display so that the control circuit 20 includes a switch element 22 and a driving element 24. The switch element 22 is coupled between the data line Vdata and the gate of the driving element 24. The gate of the switch element 22 is coupled to the gate line Vg(n). The driving element 24 is coupled between the display element 10 and the power source VDD. The switch element 22 and the driving element 24 may be a transistor switch, but is not limited thereto.

The photosensitive element 30 is coupled between the gate line Vg(n) and readout line $V_L$. When an object such as finger etc. touches the display and the light of the display element 10 is reflected by the object, or ambient light is covered/masked by the object, the photosensitive element 30 may generate a current at the readout line $V_L$ to sense the position of the object according to the reflected light or the shadow portion. In one embodiment, the control terminal of the photosensitive element 30 is coupled to the adjacent gate line Vg(n+1) of the adjacent pixel or adjacent gate line. In another embodiment, the control terminal of the photo element 30 may be coupled to the gate line of a non-adjacent pixel or non-adjacent gate lines.

The photosensitive element 30 may be a three-terminal photo transistor, a four-terminal photo transistor, a single metal gate photo transistor, a single transparent gate photo transistor, a transparent dual-gate photo transistor, or a transparent/metal dual-gate photo transistor, but is not limited thereto. Different photosensitive elements are applied to sense light in different embodiments.

Figure 2:
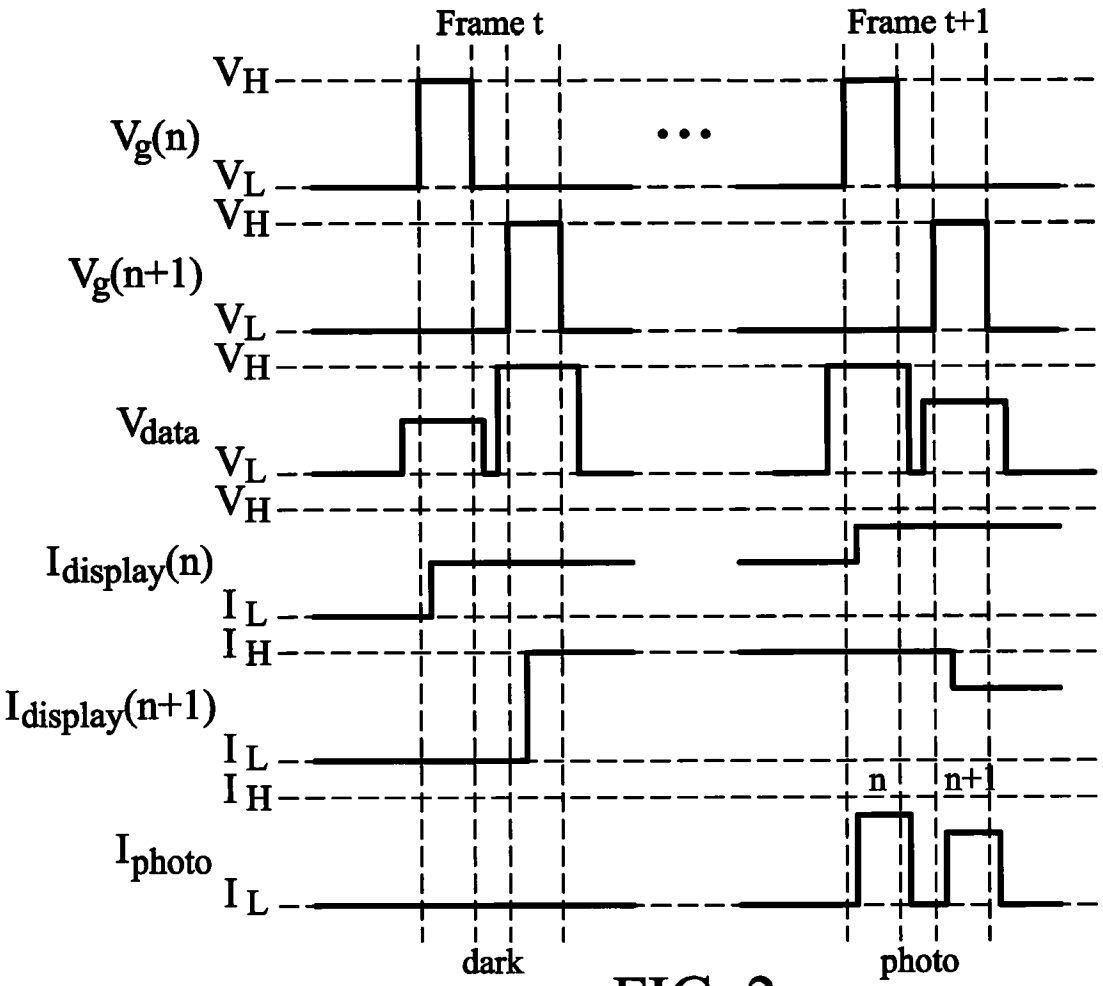
FIG. 2 is a driving scheme of the photosensitive circuit of the FIG. 1.

FIG. 2 is an exemplary driving scheme of the photosensitive circuit of the FIG. 1 working in light reflection mode. The driving scheme in shadow mode (not shown) is also described in the following, as indicated. The waveform of the Frame t is a driving scheme when there is no object touching the display. The waveform at the Frame t+1 is a driving scheme when there is an object touching the display. When there is no object touching the display, the photosensitive element 30 cannot sense reflected light by an object such that the photocurrent ($I_{photo}$) remains low. In shadow mode (not shown), however, when there is no object touching the display, the photosensitive element 30 can sense the ambient light such that there is change in photocurrent ($\Delta I_{photo}=0$) from low current ($I_L$) to high current ($I_H$) levels. In the light reflection case, when the display is touched by an object, the driving scheme is described as following.

It should be understood that the waveform status at the Frame t+1 follows the waveform status at the Frame t. In an embodiment, FIG. 2 illustrates the operation situations of two pixels at the Frame t and the Frame t+1. At first, the operation situation of the pixel n is illustrated. When the gate line Vg(n) is activated, such as activated to a high level, and the data line Vdata is activated with a corresponding signal, such as activated to a high level, the switch element 22 is turned on. The signals at data line Vdata are sent to the gate of the driving element 24, and turns on the driving element 24 such that the display element 10 produces light (because the voltage of the data line Vdata at the Frame t+1 is higher than that of the data line Vdata at the Frame t, the current $I_{display}(n)$ generated by the display element 10 is higher). The gate line Vg(n) is at a high voltage and the gate line Vg(n+1) is at a low voltage, so that the photosensitive element 30 is turned off. However, the photosensitive element 30 may sense light so that the current $I_{photo}$ is produced at the readout line $V_L$. In shadow mode (not shown), operations are similar except that the photosensitive element 30 may not sense the ambient light blocked by the object so that the current $I_{photo}$ remains low at the readout line $V_L$ when the gate line Vg(n) is at a high voltage and the gate line Vg(n+1) is at a low voltage.

Next, in the light reflection mode, the operation of the pixel n+1 is illustrated. When the gate line Vg(n+1) is activated, such as activated to a high level, and the data line Vdata is activated to a corresponding logic signal, such as activated to a high level, the switch element (not shown) in the pixel n+1 is turned on. The signals at the data line Vdata are sent to the gate of the driving element (not shown) in the pixel n+1. The signals at the data line Vdata turn on the driving element in the pixel n+1 such as the display element 10 (not shown) of the pixel n+1 generates light (the voltage of the data line Vdata at the Frame t+1 is lower than that of the data line Vdata at the Frame t so that the current $I_{display}(n+1)$ generated by the display element (not shown) is reduced slightly. Because the gate line Vg(n+1) is at a high level and the gate line Vg(n) is at a low level, the photosensitive element 30 of the pixel n does not generate current (this is true even if an object touching the display induces reflected light). However, the photosensitive element (not shown) in the pixel n+1 can sense light so that the current $I_{photo}$ is generated at the readout line $V_L$. In shadow mode (not shown), operations are similar except that the photosensitive element (not shown) may not sense the ambient light blocked by the object so that the current $I_{photo}$ remains low at the readout line $V_L$ when the gate line Vg(n) is at a low voltage and the gate line Vg(n+1) is at a high voltage.

Figure 3:
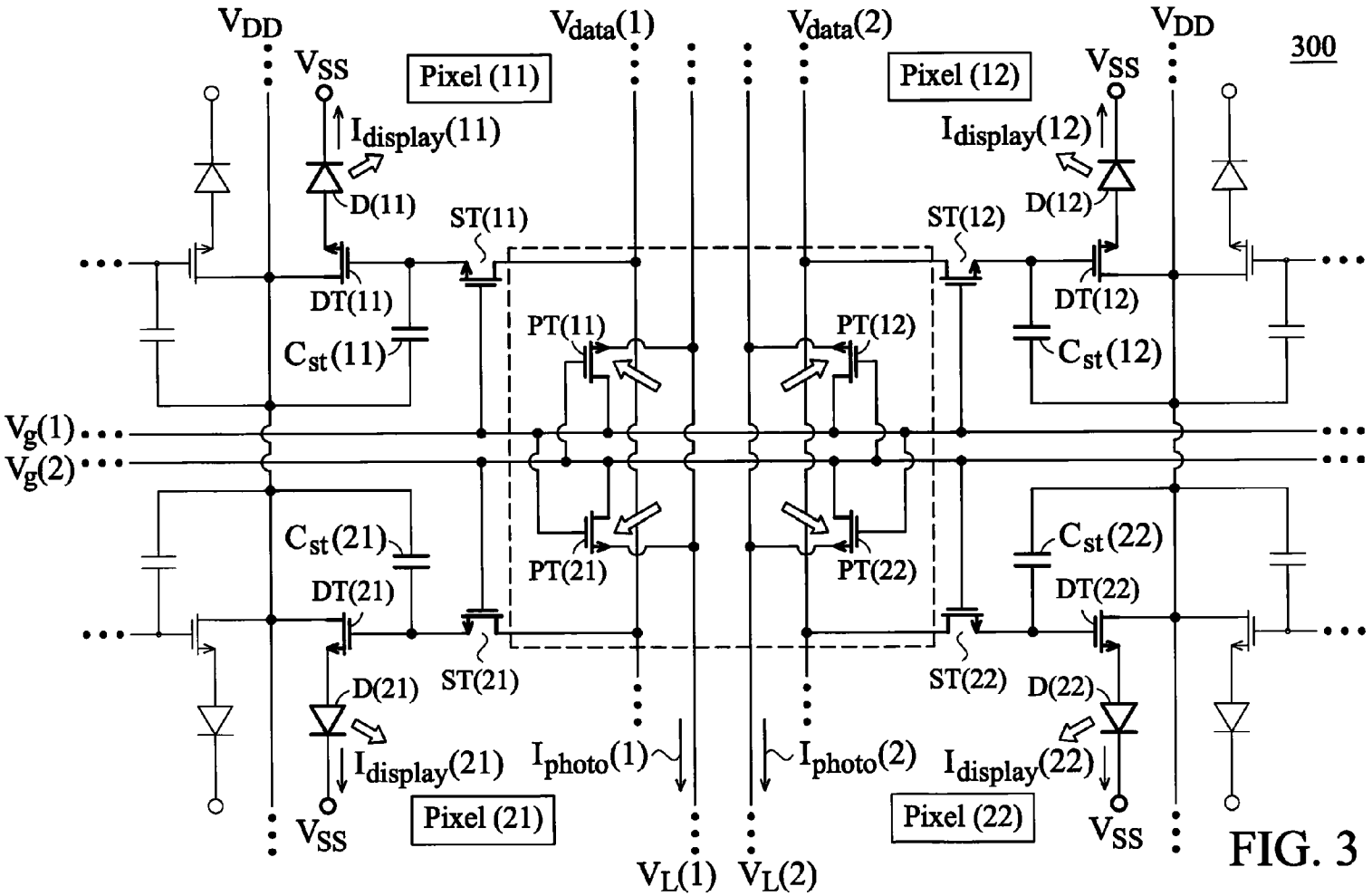
FIG. 3 is an embodiment of a photosensitive circuit of a pixel unit.

FIG. 3 is an embodiment of a photosensitive circuit of a pixel unit. The pixel unit of FIG. 3 is made up of four pixels of FIG. 1. The gate of the photosensitive element PT (12) in the pixel (12) is connected to the gate line Vg(2) and the gate of the photosensitive element PT (22) in the pixel (22) is connected to the gate line Vg(1). The gate of the photosensitive element PT(11) in the pixel (11) is connected to the gate line Vg(2) and the gate of the photosensitive element PT(21) in the pixel (21) is connected to the gate line Vg(1). The sources of the photosensitive elements PT(11) and PT(21) are connected to the readout line $V_L$(1), and the sources of the photosensitive elements PT(12) and PT (22) are connected to the data line $V_L$(2).

Figure 4:
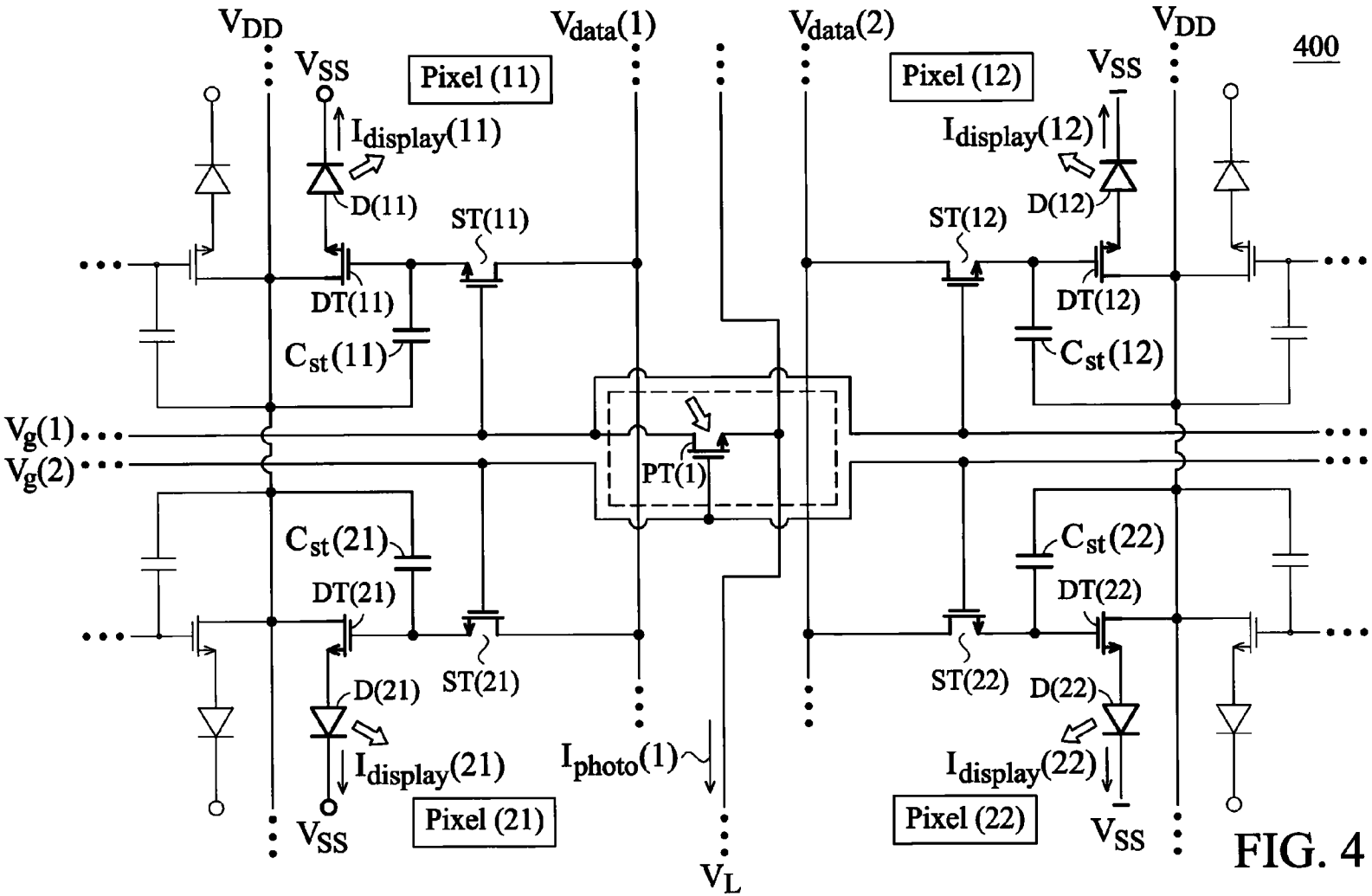
FIG. 4 is another embodiment of a photosensitive circuit of a pixel unit.

In another embodiment, a photosensitive display system can be formed according to the photosensitive circuit of the pixel unit in FIG. 3. The photosensitive circuit includes a display element for generating light, transmitting light or reflecting light. The photosensitive circuit further includes a control circuit, coupled to the display element, for controlling light intensity of the display element according to a data line and a gate line. The photosensitive circuit further includes a photosensitive element, coupled between the gate line and a readout line, for generating a current to sense a position of an object according to a reflected light or shadow portion when the light from the display element is reflected by the object or ambient light is covered by the object. Wherein a control terminal of the photosensitive element is coupled to a gate line of another pixel FIG. 4 is another embodiment of a photosensitive circuit of a pixel unit. The photosensitive circuit includes the pixel unit 400 and a photosensitive element PT(1). The pixel unit 400 includes a pixel (11), a pixel (12), a pixel (21) and a pixel (22). Each pixel includes a display element and a control circuit. In one embodiment, when the photosensitive circuit is applied to a TFT LCD, a switch (for example, a transistor) can be used to control and drive the display element. In other embodiment, when the photosensitive circuit is applied to an OLED, the control circuit includes a switch element and a driving element. For example, the pixel (11) includes a display element D(11), switch element ST(11) and driving element DT(11). The switch element ST(11) is coupled between the data line Vdata(1) and the gate of the driving element DT(11), and the gate of the switch element ST(11) is coupled to the gate line Vg(1). The driving element DT(11) is coupled between the display element D(11) and power source VDD. The switch element ST(11) and the driving element DT(11) may be a transistor switch, but is not limited thereto. The photosensitive element PT(1) is coupled between the four pixels used for sensing light of the four pixels. In one embodiment, such as high resolution display, the object touching the display must cover several pixels. So, a photosensitive element is enough to sense object position. The drain of the photosensitive element PT(1) is coupled to the gate line Vg(1), and its source is coupled to the readout line $V_L$, and its gate is coupled to the gate line Vg(2).

Figure 5:
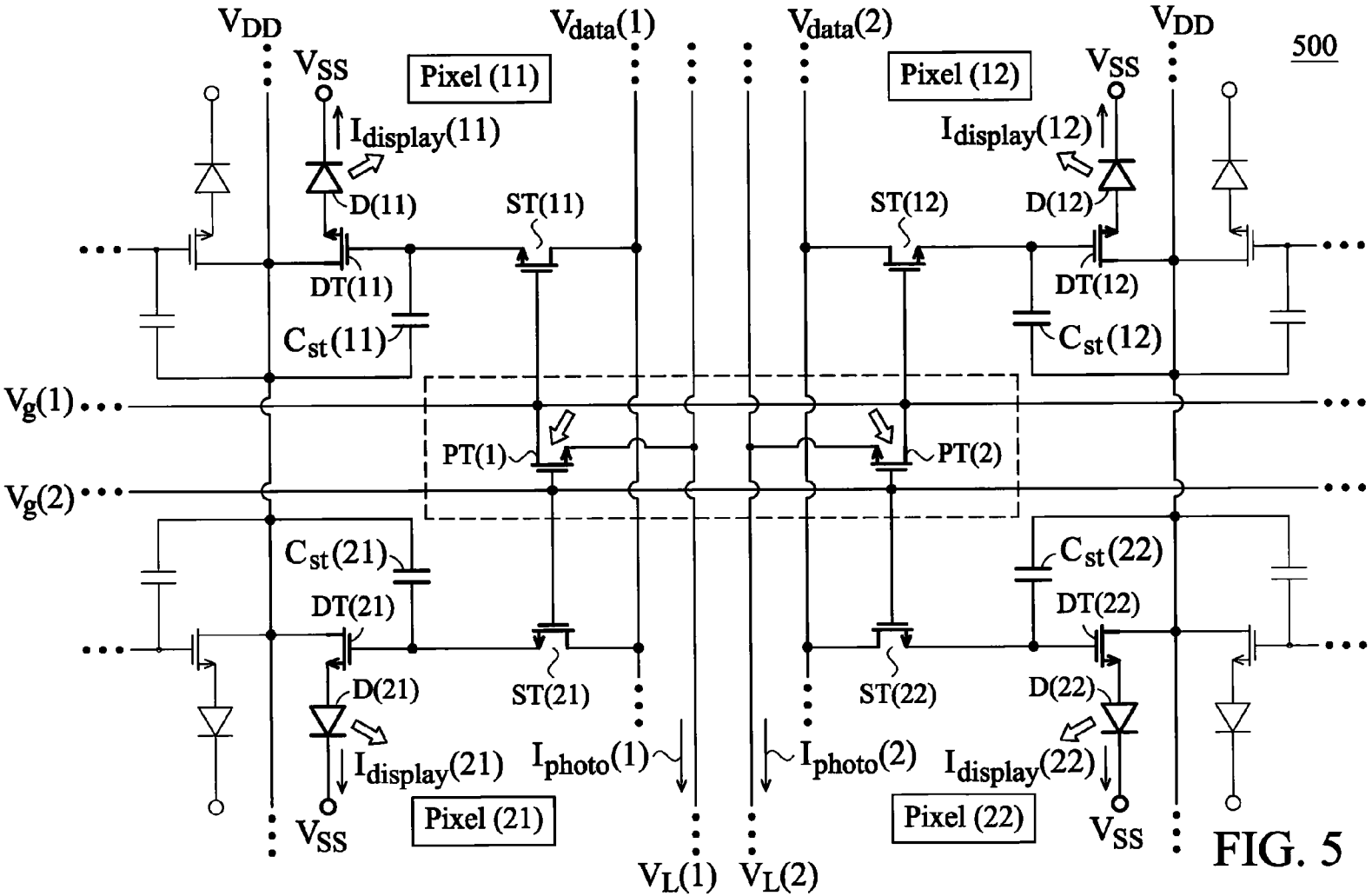
FIG. 5 is another embodiment of a photosensitive circuit of a pixel unit.

FIG. 5 is another embodiment of a photosensitive circuit of a pixel unit. The photosensitive circuit includes the pixel unit 500 and two photosensitive elements PT(1) and PT(2). The pixel unit 500 includes a pixel (11), a pixel (12), a pixel (21) and a pixel (22). Each pixel includes a display element and a control circuit. In one embodiment, when the photosensitive circuit is applied to a TFT LCD, a switch (for example, a transistor) can be used to control and drive the display element. In other embodiment, when the photosensitive circuit is applied to an OLED, the control circuit includes a switch element and a driving element. For example, the pixel (11) includes a display element D(11), switch element ST(11) and driving element DT(11). The switch element ST(11) is coupled between the data line Vdata(1) and the gate of the driving element DT(11), and the gate of the switch element ST(11) is coupled to the gate line Vg(1). The driving element DT(11) is coupled between the display element D(11) and the power source VDD. The switch element ST(11) and the driving element DT(11) may be a transistor switch, but is not limited thereto. The photosensitive elements PT(1) and PT(2) is coupled between the four pixels used for sensing light of the four pixels. In one embodiment, for example when the display is not a high resolution display, the object touching the display covers less pixels. So, two photosensitive elements are used to sense the position of an object. The drain of the photosensitive element PT(1) is coupled to the gate line Vg(1), the source of the photosensitive element PT(1) is coupled to the readout line $V_L$(1), and the gate of the photosensitive element PT(1) is coupled to the gate line Vg(2). The drain of the photosensitive element PT(2) is coupled to the gate line Vg(2), the source of the photosensitive element PT(2) is coupled to the readout line $V_L$(2), and the gate of the photosensitive element PT(2) is coupled to the gate line Vg(1).

Figure 6:
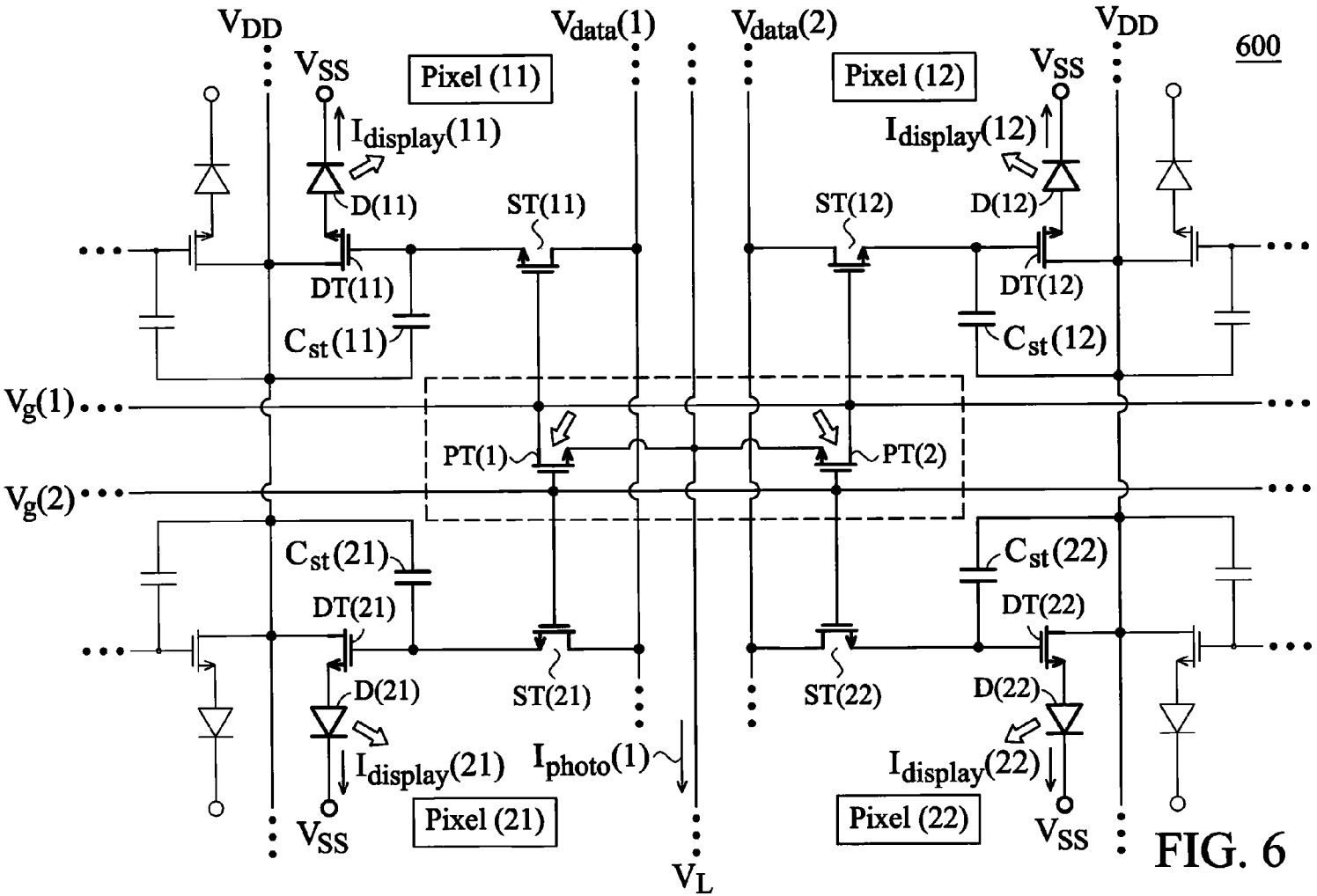
FIG. 6 is another embodiment of a photosensitive circuit of a pixel unit of the display.

FIG. 6 is another embodiment of a photosensitive circuit of a pixel unit of the display. The photosensitive circuit in FIG. 6 is improved when compared to the photosensitive circuit in FIG. 5. In one embodiment, the readout line $V_L$(1) and $V_L$(2) can be integrated into a readout line $V_L$.

In another embodiment, a photosensitive display system is formed according to the photosensitive circuit in FIG. 4, FIG. 5 or FIG. 6. The photosensitive circuit includes a pixel unit and a photosensitive unit. The pixel unit comprises four pixels, wherein each pixel comprises a display element and a control circuit. The display element is used for generating light, transmitting light or reflecting light. The control circuit is coupled to the display element and is used for controlling light intensity of the display element according to a data line and a gate line. The photosensitive unit is coupled between the four pixels for generating a current at a readout line to sense a position of an object according to a reflected light or shadow portion when the light from the display element is reflected by the object or ambient light is covered by the object. Wherein the photosensitive unit comprises at least one photosensitive element, coupled between a first gate line and the readout line. Wherein a control terminal of the photosensitive element is coupled to a gate line of another pixel.

While the disclosure has been described by way of example and in terms of the embodiments, it is to be understood that the disclosure is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A photosensitive circuit, adapted to a pixel in a pixel array, comprising:

a display element for generating light, transmitting light or reflecting light;

a control circuit, coupled to the display element, for controlling light intensity of the display element according to a data line and a gate line; and a photosensitive element, coupled between the gate line and a readout line, for generating a current to sense a position of an object according to a reflected light or shadow portion when the light from the display element is reflected by the object or ambient light is covered by the object;

wherein the photosensitive element is a photo transistor, having a control terminal directly connected to a gate line of another pixel.

2. The photosensitive circuit as claimed in claim 1, wherein the control circuit comprises at least one switch element which is turned on or turned off according to the data line and the gate line.

3. The photosensitive circuit as claimed in claim 2, further comprising a driving element, coupled between the display element and the switch element for driving the display element.

4. The photosensitive circuit as claimed in claim 1, wherein the photosensitive element is a three-terminal photo transistor, a four-terminal photo transistor, a single metal gate photo transistor, a single transparent gate photo transistor, a transparent dual-gate photo transistor, or a transparent/metal dual-gate photo transistor, used for sensing light.

5. A photosensitive circuit, comprises:

a pixel unit comprising four pixels, wherein each pixel comprises a display element and a control circuit; and a photosensitive unit, coupled between the four pixels for generating a current at a readout line to sense a position of an object according to a reflected light or shadow portion when the light from the display element is reflected by the object or ambient light is covered by the object, wherein the photosensitive unit comprises at least one photosensitive element, coupled between a first gate line and the readout line; and wherein the photosensitive element is a photo transistor, having a control terminal directly connected to a second gate line.

6. The photosensitive circuit as claimed in claim 5, wherein two of the four pixels share the first gate line and the other two share the second gate line.

7. The photosensitive circuit as claimed in claim 5, wherein when the photosensitive unit comprises a plurality of photosensitive elements, each is coupled between a corresponding readout line and the first gate line.

8. The photosensitive circuit as claimed in claim 5, wherein the photosensitive element is a three-terminal photo transistor, a four-terminal photo transistor, a single metal gate photo transistor, a single transparent gate photo transistor, a transparent dual-gate photo transistor, or a transparent/metal dual-gate photo transistor, used for sensing light.

9. A photosensitive display system, comprising:

an array of pixels, wherein each pixel comprises a photosensitive circuit, wherein the photosensitive circuit comprises:

a display element for generating light, transmitting light or reflecting light;

a control circuit, coupled to the display element, for controlling light intensity of the display element according to a data line and a gate line; and a photosensitive element, coupled between the gate line and a readout line, for generating a current to sense a position of an object according to a reflected light or shadow portion when the light from the display element is reflected by the object or ambient light is covered by the object;

wherein the photosensitive element is a photo transistor, having a control terminal directly connected to a gate line of another pixel.

10. The photosensitive circuit as claimed in claim 9, wherein the control circuit comprises at least one switch element which is turned on or turned off according to the data line and the gate line.

11. The photosensitive circuit as claimed in claim 10, further comprising a driving element, coupled between the display element and the switch element for driving the display element.

12. The photosensitive circuit as claimed in claim 9, wherein the photosensitive element is a three-terminal photo transistor, a four-terminal photo transistor, a single metal gate photo transistor, a single transparent gate photo transistor, a transparent dual-gate photo transistor, or a transparent/metal dual-gate photo transistor, used for sensing light.

13. A photosensitive display system, comprising:

an array of photosensitive circuit, wherein each photosensitive circuit comprises:

a pixel unit comprising four pixels, wherein each pixel comprises a display element and a control circuit; and a photosensitive unit, coupled between the four pixels for generating a current at a readout line to sense a position of an object according to a reflected light or shadow portion when the light from the display element is reflected by the object or ambient light is covered by the object, wherein the photosensitive unit comprises at least one photosensitive element, coupled between a first gate line and the readout line; and wherein the photosensitive element is a photo transistor, having a control terminal directly connected to a second gate line.

14. The photosensitive circuit as claimed in claim 13, wherein two of the four pixels share the first gate line and the other two share the second gate line.

15. The photosensitive circuit as claimed in claim 13, wherein when the photosensitive unit comprises a plurality of photosensitive elements, each is coupled between a corresponding readout line and the first gate line.

16. The photosensitive circuit as claimed in claim 13, wherein the photosensitive element is a three-terminal photo transistor, a four-terminal photo transistor, a single metal gate photo transistor, a single transparent gate photo transistor, a transparent dual-gate photo transistor, or a transparent/metal dual-gate photo transistor, used for sensing light.

17. The photosensitive circuit as claimed in claim 1, wherein the photosensitive element consists of the photo transistor having only a single control terminal.

18. The photosensitive circuit as claimed in claim 1, wherein the photo transistor includes only a single control terminal.

* * * * *

UNITED STATES PATENT AND TRADEMARK OFFICE

CERTIFICATE OF CORRECTION

PATENT NO. : 8,575,530 B2
APPLICATION NO. : 12/979920
DATED : November 5, 2013
INVENTOR(S) : Chan et al.

It is certified that error appears in the above-identified patent and that said Letters Patent is hereby corrected as shown below:

Title Page, Item (75) Inventor is corrected to read:
-- Isaac Wing-Tak Chan, Hsinchu (TW);
Chen-Pang Kung, Taoyuan County (TW) --.

Signed and Sealed this
Thirteenth Day of October, 2015

Michelle K. Lee

Michelle K. Lee
*Director of the United States Patent and Trademark Office*